US005926442A

United States Patent [19]

Sirhan et al.

[11] Patent Number: 5,926,442

[45] Date of Patent: Jul. 20, 1999

[54] ALARM CLOCK SYSTEM INCORPORATING A GAME OF SKILL

[75] Inventors: Eddie Sirhan, San Meteo, Calif.; Alan Amron, Woodbury, N.Y.

[73] Assignee: Amron Development, Inc., N.Y.

[21] Appl. No.: 09/241,388

[22] Filed: Feb. 2, 1999

[51] Int. Cl.[6] ..... G04B 23/02; G04B 23/00

[52] U.S. Cl. ..... 368/73; 368/262

[58] Field of Search ..... 368/72–74, 250, 368/260–263

[56] References Cited

U.S. PATENT DOCUMENTS

| | | |
|---|---|---|
| 4,218,875 | 8/1980 | Rothman . |
| 4,316,273 | 2/1982 | Jetter . |
| 4,352,170 | 9/1982 | Jetter . |
| 4,352,171 | 9/1982 | Jetter . |
| 5,379,573 | 1/1995 | Horiner . |

*Primary Examiner*—Vit Miska

*Attorney, Agent, or Firm*—Brian Dinicola, Esq.

[57] ABSTRACT

A novelty alarm clock system incorporating a game of skill comprises an alarm clock base unit including a clock assembly operative to display the current time and to audibly reproduce an audible alarm when the current time corresponds to a preselected alarm time, and a sensing element. The sensing element detects a remotely actuated alarm interruption signal and, in response thereto, discontinues the audible alarm for at least an interval of time. A game of skill is introduced by the manner in which the alarm interruption signal is remotely actuated. Specifically, a remote hand-held unit supplies a narrowly focused visible beam of light which must be precisely aligned with the sensing element (i.e., the target) on the alarm clock base unit in order to terminate or suspend reproduction of the audible alarm signal. Illustrative embodiments of the remote unit include a toy gun configuration, in which the focused beam passed through a barrel, and a wand structure, in which the focused beam passes through a bore through the wand and out an opening at one end.

13 Claims, 6 Drawing Sheets

ALARM CLOCK SYSTEM INCORPORATING A GAME OF SKILL

BACKGROUND OF THE INVENTION

1. Field of the Invention

The present invention relates generally to the field of alarm clocks, and more particularly to a novelty alarm clock incorporating a game feature, in which an activated alarm signal is rendered inoperative in response to the actuation of a remotely operated actuator.

2. Description of the Prior Art

For most people, the beginning of a work day is announced by an alarm clock. However, the transition from sleep to wakefulness is difficult for many people, and numerous practices and devices have been implemented with the intention of facilitating this transition. Some people use alarm clocks with unpleasant or extraordinarily loud audible signals, to jar the sleeper awake. Others place their alarm clocks at a distance from their beds, so that physical activity is required to deactivate the alarm. Such abrupt methods of waking the sleeper are undesirable to many. For a more gently transition to wakefulness many "clock radios" are available, in which a radio and an alarm clock are incorporated into a single unit. In most of these devices the user may choose to be awakened by music from a radio broadcasting station of their choice, rather than by a traditional alarm signal. Unfortunately, this approach, while gentle, often results in oversleeping, as it is easy for many to continue to sleep in the presence of music. Indeed, music is often used to encourage sleep.

A middle ground between the abrupt and gentle approach to alarm clocks is found in the use of a "snooze button," by which an activated alarm signal is rendered temporarily inoperative, affording the sleeper additional rest after being initially awakened, and thereby allowing a sleeper opportunity to awaken gradually. In current implementations of such a delay feature, the snooze button is located on the alarm clock, which is then placed in close proximity to the sleeper to allow the snooze feature to be activated without the sleeper getting out of bed. Unfortunately, convenient use of such a snooze feature requires placement of the clock within close proximity to the user, which can result in several problems. First, such placement of the alarm clock unit allows for repeated use of the snooze feature, which can result in oversleeping. Close proximity of the alarm clock unit to the sleeper also allows for easy permanent deactivation of the alarm signal, which again can result in oversleeping. In addition, the common use of luminous or lighted displays for nighttime visibility can prove a significant impediment to sleep when such displays are close to the sleeper. Finally, having to place the alarm clock unit near the sleeper can limit visibility of the time information from other vantage points within the room, as well as conflict with more aesthetic considerations.

Examples of prior art alarm clocks with some kind of remote controller include that taught in U.S. Pat. No. 4,316,273 by Jetter, which proposes a local alarm signal unit, placed in close proximity to the sleeper, with a remote unit containing means for deactivating the alarm. The remote placement of the deactivating unit forces the sleeper to get out of bed and move to the location of the deactivating unit in order to stop the alarm signal. In this teaching the awakened person is further required to hold the deactivation switch for several seconds, for the purpose of insuring the operator has thoroughly awakened, and thus preventing oversleeping. Once the deactivation requirements have been met, the disabling of the alarm signal is permanent. The teaching of Jetter further requires that the sleeper either get up immediately and satisfy the requirements for deactivating the alarm system, or otherwise endure the alarm signal. Thus, the teaching of Jetter uses separation of the alarm deactivating means from the alarm signal means in order to abruptly force wakefulness upon the user.

Another example of a prior art alarm clock device utilizing a remote control unit to deactivate and alarm signal is described in U.S. Pat. No. 5,379,273 issued to Kevin Horinek. In this implementation, provisions are made in the alarm clock for a snooze button which is activated by a hand held remote control unit. A limitation is placed on the number of times the user may utilize the remote control unit, so that a gradual, though finite, period is provided to bring the operator to wakefulness. Though such a configuration is significantly more gentle than the Jetter approach, and thus achieves the purposes for which it was made, it does not provide any genuine relief from the routine experience of waking up in the morning.

Yet another prior art device in which an alarm clock system is separated into two elements is disclosed by Rothman in U.S. Pat. No. 4,218,875. In this invention, the alarm signal portion of the alarm clock is demountably attached to a clock and is adapted to be removed from the clock and thrown against a surface without harm to the alarm signal unit. In this teaching, the alarm signal is deactivated following impact of the alarm signal unit with a surface. Thus a cathartic device is provided for a sleeper who is annoyed by the alarm signal, and also provides a novel means for deactivating the alarm. The invention proposed by this teaching does not help prevent termination of the alarm signal prematurely, that is, before the sleeper is fully awakened. Moreover, this invention does not provide remote control over the alarm, as the throwable portion of the alarm must be attached to the base unit during the inactive period of the alarm.

While any of the aforementioned prior art devices may be said to bring the sleeping person to full wakefulness within a certain interval of time, it will be appreciated that there is no aspect of skill or challenge to their operation by which the process of waking up in the morning might become more enjoyable or, abandoning hyperbole, less to be dreaded.

SUMMARY OF THE INVENTION

The aforementioned deficiencies are addressed, and an advance is made in the art, by a novelty alarm clock system that incorporates a game of skill. The alarm clock system of the present invention comprises an alarm clock base unit including a clock assembly operative to display the current time and to audibly reproduce an audible alarm when the current time corresponds to a preselected alarm time, and a sensing element. The sensing element detects a remotely actuated alarm interruption signal and, in response thereto, discontinues the audible alarm for at least an interval of time. A game of skill is introduced by the manner in which the alarm interruption signal is remotely actuated. Specifically, a remote hand-held unit supplies a narrowly focused visible beam of light which must be precisely aligned with the sensing element (i.e., the target) on the alarm clock base unit before the clock assembly will terminate or suspend reproduction of the audible alarm signal. Illustrative embodiments of the remote unit include a toy gun configuration, in which the focused beam passed through a barrel, and a wand structure, in which the focused beam passes through a bore through the wand and out an opening at one end.

In accordance with an especially preferred embodiment of the present invention, the sensing element operates in conjunction with a "snooze alarm" circuit to suspend or delay operation of the alarm for a predetermined interval. The present invention thus achieves all of the purposes of the prior art alarm clocks, while also making the experience of waking more challenging and enjoyable.

For a better understanding of the invention, its operational advantages, and the specific objects attained by its uses, reference should be made to the accompanying drawings and descriptive matter in which are illustrated various embodiments of the invention. Those skilled in the art will readily ascertain, however, that the invention is capable of other embodiments and of being practiced and carried out in various ways. In this respect, the details of construction disclosed herein, and the arrangements of the components set forth in the following description and appended drawings are for illustrative purposes, only, and are not intended to be limiting in scope.

BRIEF DESCRIPTION OF THE DRAWINGS

The various aspects which characterize the invention will be better understood and appreciated when consideration is given to the following detailed description, and to the accompanying drawings, in which.

DETAILED DESCRIPTION OF THE VARIOUS EMBODIMENTS

Figure 1A:
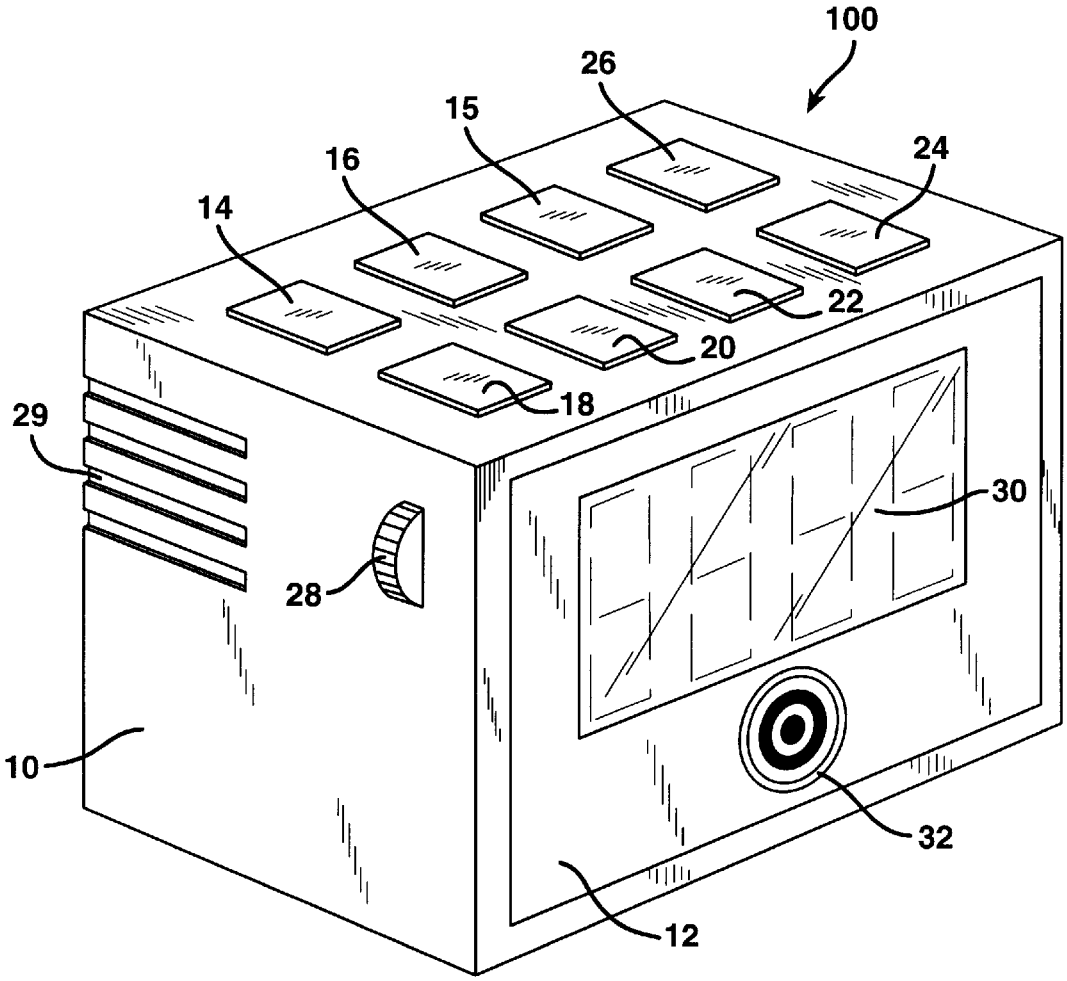
FIG. 1A is a perspective view of an embodiment of a base unit of the alarm clock system according to the present invention.

With initial reference to FIGS. 1A and 1B, art illustrative embodiment of the novelty alarm clock system of the present invention, which includes an alarm clock base unit 100 (FIG. 1A) and a hand-held remote unit 200 (FIG. 1B) will now be described. Turning first to FIG. 1A, it will be seen that alarm clock base unit 100 comprises an exterior housing 10, which includes in its front face a display panel 12, and on the upper surface thereof a number of momentary contact push-buttons for controlling various conventional alarm clock functions. Illustratively provided are push button 14 for time and date setting selection ("TDSS"), push button 16 for time and date adjustment, push button 18 for alarm setting, push button 20 for alarm adjustment 20, push button 22 for alarm select/enable operation, push button 24 for alarm deactivation, and push button 26 ("SNOOZE") for local suspension or delay of the alarm.

The left side of the base unit 100 includes a control wheel 28 connected to an internally fixed variable resistor (not shown), for adjusting the display brightness by appropriate rotation thereof. The left side of the base unit 100 further includes a plurality of horizontal ventilation slots 29 which extend from the back left edge of the base unit 100 toward the front of said unit for allowing escape of air heated by operation of the electronic circuitry contained inside the base unit 100.

Those skilled in the art will be aware of a variety of means which are well known and used to select and adjust alarm system parameters, including key means, push-buttons and rotatable dials or wheels, said means including appropriate conditioning circuitry for suitable interfacing to the other clock system electronics. As well, those skilled in the art will recognize various other designs, shapes, sizes and configurations for forming the base unit 100 and the remote alarm controller 200, which may perform in substantially the same manner as the embodiments of those elements described and illustrated herein, according to the present invention, it should be understood, therefore, that the overall aesthetic design, and the choice of selection and adjustment means used in this embodiment of the present invention are not intended to be limiting.

Returning to FIG. 1A, it will be seen that the front display panel 12 comprises a translucent high-impact plastic material, such as that which is well known, for protecting various optoelectronic display elements which are mounted behind the panel 12. In the base unit 100, the optoelectronic display elements include: a large 3-inch high four-by-one character numeric time LED (light emitting diode) panel 30 mounted in the upper portion of the display panel 12 for displaying the current time and various selectable alarm times. By suitable operation of push button 27, panel 30 may be further caused to sequentially display the current, the preferred alarm time with indication of armed/disarmed status, and the selected duration of the alarm delay.

As indicated previously, it is a principal object of the alarm clock system of the present invention to introduce an aspect of skill and challenge to the experience of waking. For that reason, display panel 12 further includes a sensing element 32 for providing an alternate means of suspending operation of the alarm produced by the alarm clock base unit 100 when the current time matches the preferred alarm time previously input by the user. In the illustrative embodiment depicted in FIG. 1A, the sensing element 32 comprises a conventional photocell which is configured in the form of target. As will be readily appreciated by those skilled in the art, by operation of such a cell, a sufficiently focused beam of incident light is converted into an electrical signal that may be used to drive any number of electronic systems. In the present invention, such a signal is utilized as an alternative to push button 26 to suspend audible reproduction of the alarm by the alarm clock base unit 100.

Figure 1B:
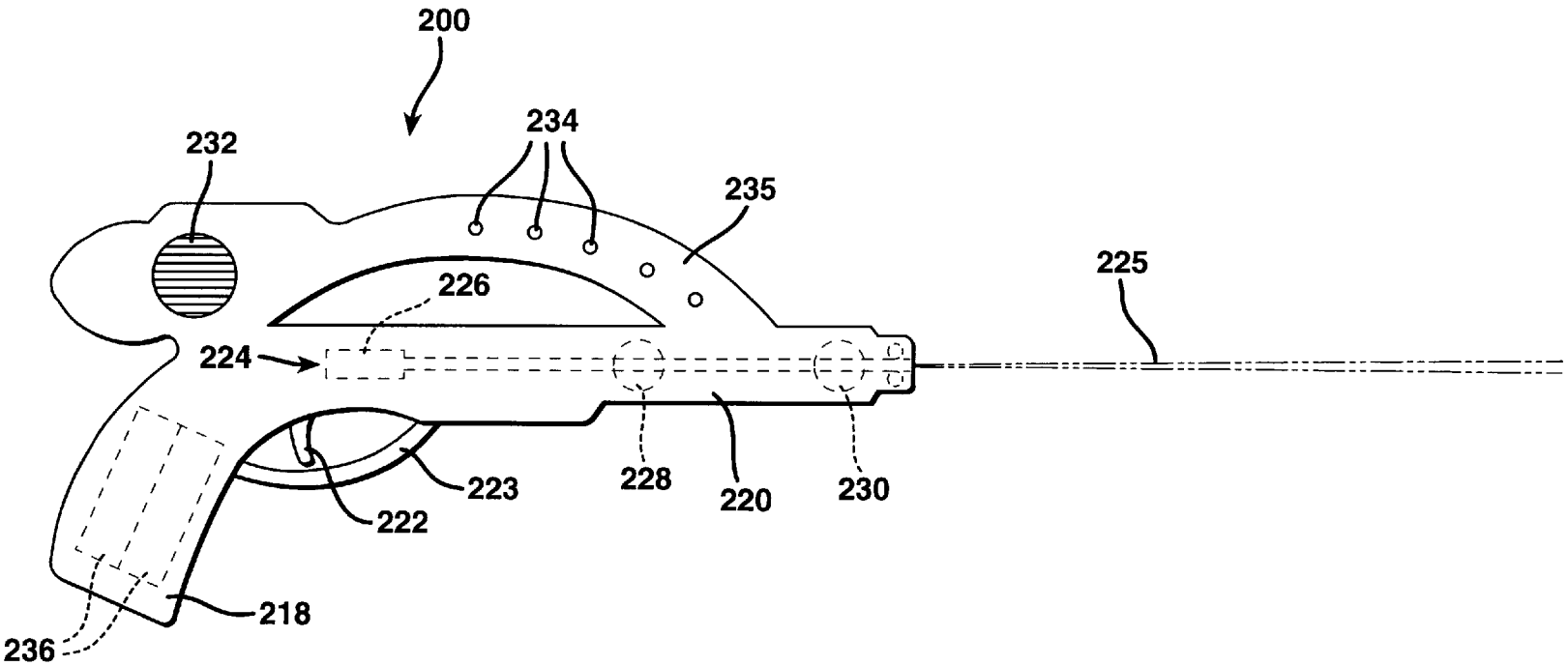
FIG. 1B and 1C are perspective views, respectively, of first and second embodiments of visible light emitting remote control units for working in conjunction with the base unit of FIG. 1A.

Turning now to FIG. 1B, the precise manner in which an aspect of skill is added to the operation of a sensing-unit-equipped alarm clock base unit of the type described above and shown in FIG. 1A will now be described. In the embodiment of FIG. 1B, the remote unit 200 takes the form of a toy gun which includes a handle 218, a barrel 220, and a spring-actuated trigger 222 within trigger guard 223. A light emitting source 224 for projecting a focused beam of light includes a conventional light emitting element 226 such, for example as a light emitting diode or incandescent light bulb, one or more focusing lenses 228, and a reflector 230. A relatively narrow beam of light 225 is momentarily projected by the gun when the trigger is pulled. To generate certain entertaining sounds, operating as first audible confirmation signals, the gun may also enclose a speaker mounted behind a speaker grill 232, and lights, in the form of light emitting diodes (LEDs) 234 which are, in the illustrative embodiment of FIG. 1B, supported on a light bridge 235. In addition, the handle 218 is provided with a battery pack receiving chamber for receiving a battery pack indicated at 236. The batteries may be of any desired type, such as alkaline batteries.

Figure 1C:
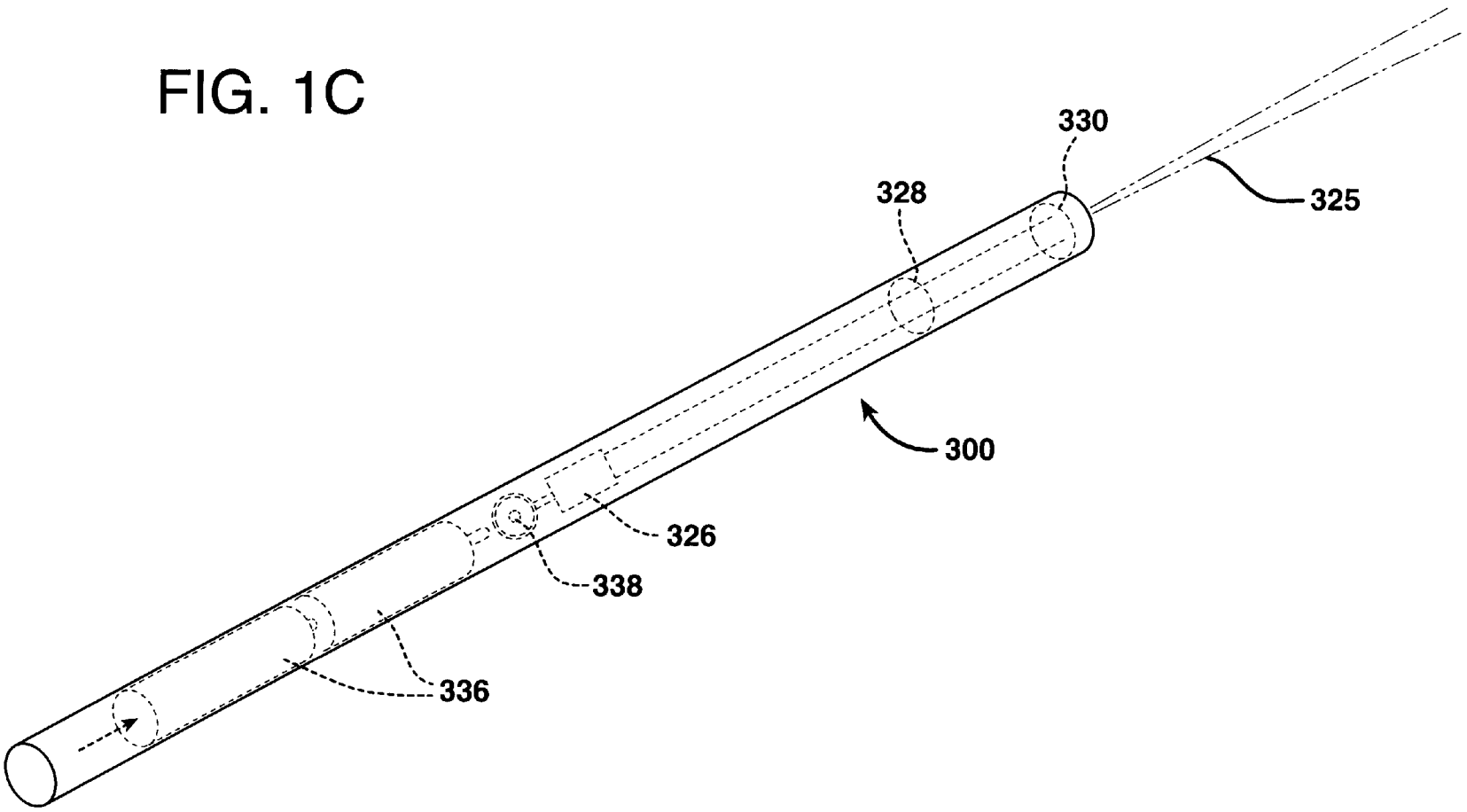

An alternative embodiment of a remote unit 300 embodying a light emitting source to operate alarm clock base unit 100 in accordance with the present invention is depicted in FIG. 1C. In this embodiment, the light emitting source 324 is configured in an identical fashion to source 224 of FIG 1B, the only principal difference being that remote unit 300 takes the form of a slender, elongated wand having a ration of length to diameter of at least 8 to 1. In lieu of a trigger operating mechanism, however, a simple on-off switching mechanism such, for example, as momentary contact, normally off pushbutton actuator 338 is employed. As in the case of the embodiment of FIG. 1B, however, a narrowly focused beam is generated—by light emitting element 326, collimating lens 328, and reflector 330 under power supplied by batteries 336—which beam, when aligned with sensing element 32 on alarm clock base unit 100, interrupts reproduction of the audible alarm.

Figure 2:
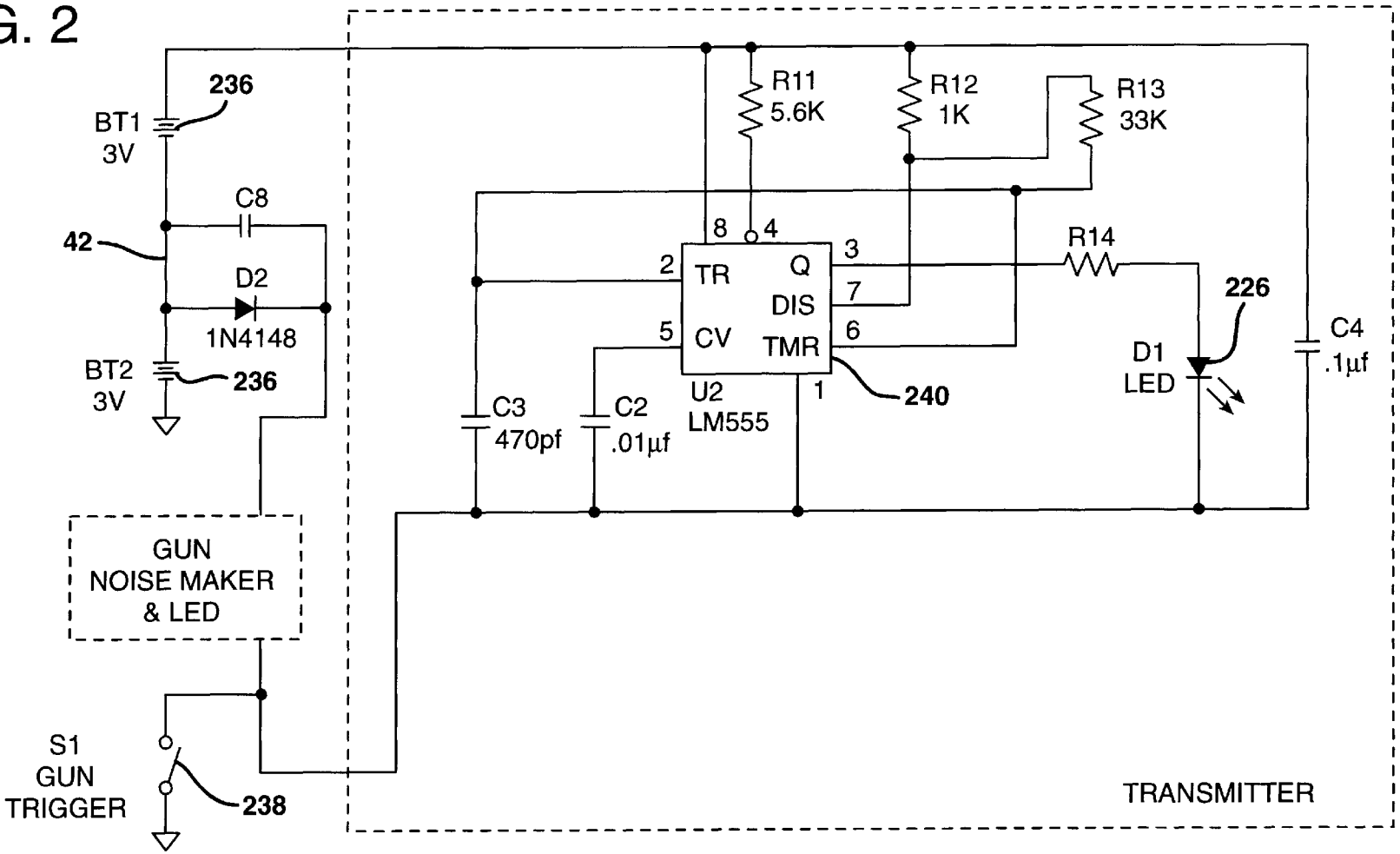
FIG. 2 is a schematic circuit diagram of the electronics underlying the principal elements of the illustrative embodiment of a remote unit depicted in FIG. 1B.

The circuit utilized for projecting the beam in the illustrative configuration of FIG. 1B is shown in FIG. 2. The circuit includes, in addition to the light emitting diode or incandescent lamp 226 and the batteries 236, a gun trigger switch 238, an LM555 integrated circuit timing device 240, and various other resistors and diodes whose values will be dependent upon both the voltage of the power supply and the effective distance and desired duration of the beam to be generated. In addition, the circuit will also include a gun noise maker in the form of a speaker, which will be mounted behind the speaker grill 232, and the LED's 224. This portion of the circuit is not illustrated as per se it does not form a part of the present invention. It should be noted that the purpose of timer 240 is to limit the length of time the unmodulated, focused beam is projected following depression of the trigger mechanism by the operator. The gun is operated by pulling the trigger which will close switch 238, illuminating the light emitting element 226 for a brief period of time (e.g., several seconds). The light from light emitting element 226 is formed into a beam by the collimating lens 228 and reflector 230, and if the barrel 220 of the remote unit 200 is accurately aimed at the sensing element 32 of alarm system base unit 100, the beam will be visibly projected thereon. At the same time, or perhaps for a longer duration of time, a suitable sound is projected through the speaker grill 232 and LED's 234 are caused to flash.

Insofar as the present invention is intended to comprise a game of skill, it should be readily apparent that the width of the beam and size of the area over which the sensing element collects incident light will, in large part, determine the degree of skill required to shut off the clock. In accordance with an illustrative embodiment of the present invention, the sensing element collection area may be selected as a circular area one inch in diameter with the diameter of the beam being constrained to a similar dimension within the distance between the remote unit 200 to the base unit 100 (illustratively, 15–25 feet).

Figure 3:
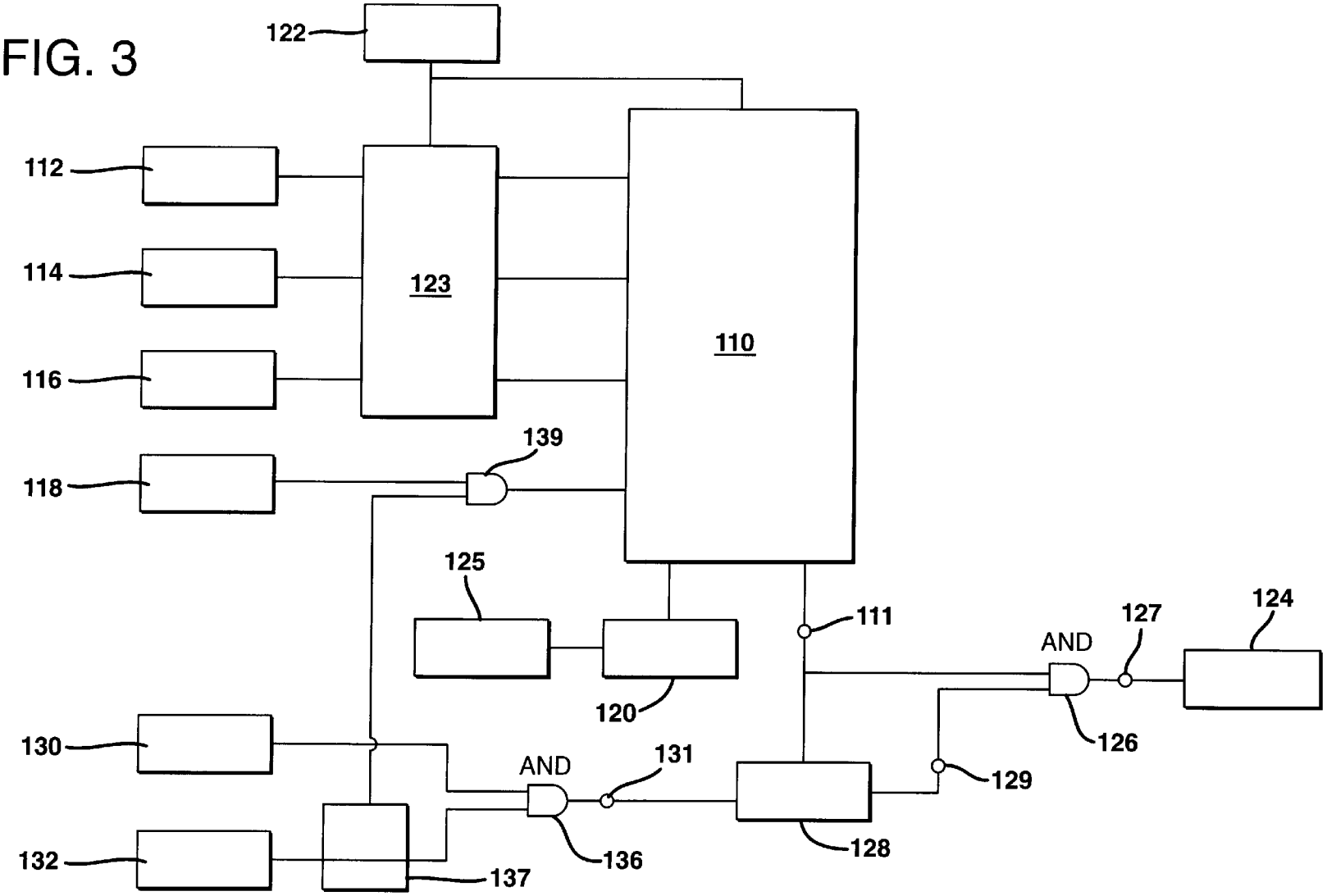
FIG. 3 is a schematic block diagram of the electronics underlying the principal elements of the illustrative embodiment of an alarm clock base unit depicted in FIG. 1A.

The manner in which alarm clock base unit operates to perform such conventional functions as time, date and alarm display, as well as the setting of the same, are not deemed to be novel aspects of the invention and are further to believed by the inventors herein to be well within the level of skill of those familiar with the art. For this reason, and in the interest of clarity of disclosure, a detail description of the same has been omitted. It thus suffices to say the alarm clock base unit of the present invention contains conventional electronic components which may be readily configured by the owner to set and store the current time and/or date, and to set and store a preferred waking or alarm time. In FIG. 3, then, it will be seen that there is shown a functional block diagram of an embodiment of the logical circuitry used to enable the features described above.

It can be seen that the center of the alarm clock system is a standard alarm clock module 110 such as is well known in the art, to which modifications have been made in order to enable the novel features of the present invention. The standard alarm clock module 110 incorporates at least electronic means for adjustment and keeping of the current time and date, means for adjustment of at least a preferred alarm time, means for enabling and disabling said at least a preferred alarm time, means for generating an electronic alarm signal, and LED display driver means 120 associated with the various LED's of the display panel 12. Integrated circuits that incorporate all of these features, and often including additional features, are well known in the art. Interfaced to the clock module 110 are current time and date setting means 112 associated with the TDSS push button 14 and the time and date adjustment push button 16 (FIG. 1A); alarm time setting means 114 associated with the alarm setting selection push button 18 and the alarm adjustment push button 20; alarm activation enabling means 116 associated with the alarm select/enable push button 22, for enabling activation of the audible alarm at a selected preferred alarm time; and alarm deactivating means 118 associated with the alarm deactivation push button 24. Still further included in the base unit 100 is means for adjusting the display brightness 125, which is associated with the control wheel 28. Said means are well known in the art, requiring only selection of the components that best accommodate external factors such as cost and desired reliability. In the event that line-supplied power is removed or absent, such as due to power failure, a backup battery 123 can provide for continued operation of the clock module. Also shown in FIG. 3 is non-volatile storage module 123 such as is well known in the art for retaining alarm system parameters as well as the current time and date when the base unit 100 is disconnected from a power source. This module is also connected to the backup battery 122.

Assuming that a preferred alarm time has been enabled, the alarm output signal 111 is low (a logic 0, or FALSE) until the current time is the same as the enabled alarm time when the alarm output signal undergoes a transition from low to high (logic 1 or TRUE). The alarm signal 111 is connected to suitable audible alarm means 124, such as a buzzer, through the first input of a two-input AND gate 126, and is also connected to alarm delay logic 128. The transition of the alarm output signal from low to high sets the output 129 of the alarm delay logic 128 to high, so that when the alarm is activated, both inputs to AND gate 126 are high, which sends the output 127 of AND gate 126 high, thereby activating the audible alarm 124. The alarm output signal 111 remains high until the alarm is deactivated by the alarm deactivation means 118. Operation of the delay feature causes the output 129 of the alarm delay logic 128 to change from high to low, which causes a low signal to appear on the output 127 of AND gate 126, disabling the audible alarm 124.

Figure 4:
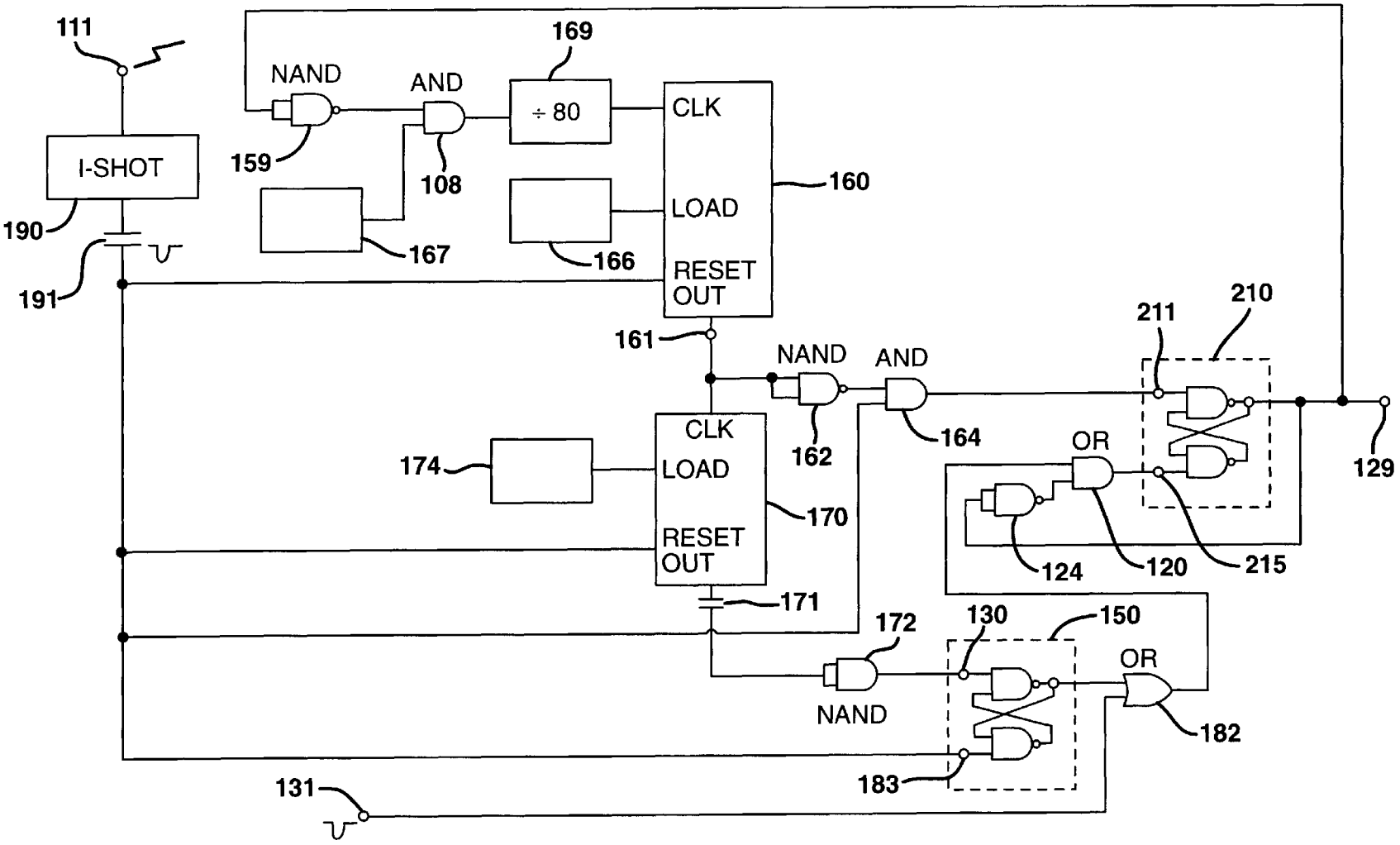
FIG. 4 is a logic diagram of the circuitry used to implement the embodiment of the alarm clock system alarm delay functions according to FIG. 3.

The alarm delay logic 128, which is illustrated in greater detail in FIG. 4, is activated by an electronic alarm delay signal 131, which emanates from either the base unit delay means 130 when the local alarm delay key 26 is depressed, or from the remote sensing element 32 in response to incidence thereon of an unmodulated, narrowly focused light beam supplied by remote unit 200. In accordance with an especially preferred embodiment of the present invention, the sensing element 32 is configured as a conventional photocell for converting the incident beam of visible light into an electrical signal and forms part of a receiver circuit 132. In that regard, it is contemplated by the inventor herein that ambient light might also be incident upon the sensing element, depending upon the lighting conditions of a particular room. For this reason, it may be desirable to include a rheostat or other adjustable means (not shown) for controlling the sensitivity threshold of the sensing element 32. For example, if the clock of the present invention is to be located in a very bright room, a low sensitivity level would be appropriate while in a dimly lit room a higher sensitivity level might be warranted.

Receiver circuit 132 further includes appropriate circuitry (not shown) for conditioning the thus converted electrical signal for input as a low pulse into AND gate 136. The electronic alarm delay signal 131 comprises a brief high-to-low pulse, hereinafter referred to as a "low pulse, " on a normally high output and can be generated by either the base unit alarm delay 130 or by the receiver circuit 132, such that a low pulse from either unit passes through a two-input AND gate 136 and into the alarm delay logic 128.

In accordance with an especially preferred form of the invention, there is further provided a selection switch mechanism 15 (FIG. 1A) whereby accurate aiming of the remote unit 200 at the sensing element 32 results in cancelation of the audible alarm, rather than mere postponement via the alarm delay logic. When the former operation is desired, switch mechanism 15 is manipulated to bring the two position switch 137 into the dotted line position shown in FIG. 3, thereby presenting the low pulse output of receiver circuit 132 to AND gate 139. The output of alarm deactivating means is also an input to AND gate 139, such that a low pulse from either unit results in deactivation of the alarm.

FIG. 4 illustrates in detail the alarm delay logic block 128 of FIG. 3, in which the alarm output signal 111 and the electronic alarm delay signal 131 are processed to control the alarm delay output 129. Assuming that a preferred alarm time has been selected and enabled before activation of the alarm, the alarm output signal 111 of the alarm clock module 110 is low. In addition, the output 161 of a duration counter 160 is normally low, and the output 171 of a delay counter 170 is also normally low. The low output 161 of the duration counter 160 is invented by NAND gate 162, resulting in a high level at the first input of AND gate 164. The low output 171 of the delay counter 170 is also inverted, by NAND gate 172, presenting a high level to the (set-high)input 181 of NAND latch 180. (Proper operation of a NAND latch requires normally high inputs.)

Operation of the alarm delay circuitry begins with alarm activation by the alarm clock module 110, which causes signal 111 to undergo a transition from a low level to a high level. This positive transition triggers a monostable multivibrator or "one-shot" 190 which emits a low "reset" pulse 191 on its normally high output. Four reset events occur because of the appearance of the low pulse 191, and are described below.

First, the reset pulse 191 is connected to the reset input of the duration counter 160. The reset pulse 191 ensures that the output 161 is low, and causes the duration counter 160 to begin counting down from any preset value 159 present on the counter 160 load inputs. In this case, the preset value 159 is the alarm delay duration period, in minutes, which is established via manipulation of the alarm setting selection key 18 and the alarm adjustment key 20, as described above. Clocking of the duration counter 160 occurs during an alarm delay period, and is described in greater detail below.

Second, the reset pulse 191 is connected to the reset input of the delay counter 170, which in the illustrated embodiment is the same type of counter used as the duration counter 160. The reset pulse 191 causes the counter 170 to begin counting down from any preset value 174 present on the counter 170 load inputs. Said preset value 174 is the maximum number of times the alarm delay may be activated, as established via manipulation of the alarm setting selection key 18 and the alarm adjustment key 20, as described above. Clocking of the duration counter 170 occurs at the end of each alarm delay period, and is further described below.

The third connection of the reset pulse 191 is to the second input of AND gate 164, and is critical to the operation of the illustrated embodiment. Because the first input to gate 164 is normally high, as described above, the low reset pulse 191 passes through AND gate 164 to the (set-high) input 211 of a NAND latch 210. The output signal from the latch 210 is the delay logic output 129. Activation of the alarm by the alarm clock module 110 causes both the signal 111 to be set high, and the signal 129 to be set high allowing activation of the audible alarm 124, as illustrated in FIG. 2A. The signal 129 also performs two additional functions. First, while signal 191 resets duration counter 160, it is important to prevent clocking of counter 160 until an alarm delay period has begun. Therefore, a high signal 129 is inverted to a low level by NAND gate 166, which prevents passage of a 1 Hz clock pulse 167 through AND gate 168, to a divide-by-sixty counter 169, thus preventing clocking of the duration counter 160. The second additional function of the signal 129 is to allow processing of an electronic alarm delay signal 131 only when the alarm is active, and not during an alarm delay period. Therefore, when the alarm is active, the high signal 129 is inverted by NAND gate 184, to present a low level to OR gate 186, allowing passage of the electronic alarm delay signal 131 through OR gate 186, and into NAND latch 210. Logically, this leads directly to a description of the operation of the alarm delay, which is related to the fourth connection of reset pulse 191.

The fourth connection of the reset pulse 191 is to the (set low) input 183 of the NAND latch 180. Because the (set high) input 181 is normally high, the reset pulse 191 sets the output of latch 180 to low, presenting a low level to the first input of OR gate 182. The presence of a low level on the first input of OR gate 182 allows the electronic alarm delay signal 131 to pass unobstructed through OR gate 182, to the second input of OR gate 186. As just described, the first input of OR gate 186 is set low by activation of the alarm, so the electronic alarm delay signal therefore passes unobstructed to the (set low) input 213 of latch 210. The output 129 of NAND latch 210 is thus reset to a low level, which blocks the alarm signal, and initiates the operation of the next stage in the alarm delay logic.

The low output 129 is then inverted by NAND gate 184, which presents a high level to the first input of OR 186, blocking processing of further alarm delay signals. Next, the low output 129 is inverted to a high level by NAND 166, which allows passage of the 1 Hz clock signal 167, into the divide-by-sixty counter 169. Once per minute, then, the duration counter 160 receives a clock pulse, counting down the minutes of the alarm duration period. With a suitable positive-clocked counter used for the counter 160, the positive pulse which finishes the counting cycle appears on the output 161 of the duration counter 160. This positive pulse is inverted by NAND gate 162, and passes through AND gate 164, which is connected to the (set high) input 211 of NAND latch 210. Signal 129, which was set to low by the alarm delay signal 131, is thus reset in high, and the alarm delay period is over. The high signal 129 is inverted by NAND gate 184, once again allowing an alarm delay signal 131 to pass through OR 186 into latch 210. Finally, note that the positive clock pulse 161 which ended the alarm delay period also is used to clock the delay counter 170, which is of the same design as counter 160 (positive clocked), so that one alarm delay period is counted.

As long as the alarm signal 111 is not deactivated, the electronic alarm delay signal 131 may be used to repeatedly operate the alarm delay circuitry. However, each operation of the alarm delay circuitry causes the delay counter 170 to record another delay event. When the maximum number of delay periods has been counted, the clock pulse providing that maximum count appears on the output 171 of the counter 170. This positive clock pulse is inverted to a low pulse by NAND 172, and this low pulse is presented to the (set high) input 181 of NAND latch 180. The output of latch 180 is thus set to a high level, which causes the output of OR gate 182 to remain high regardless of any alarm delay signals occurring on signal 131. No further alarm delay periods can be processed, then, until a new reset pulse 191 is presented to the (set low) input 183 of latch 180. Reset pulse 191 only occurs due to a transition of signal 111 from low to high, which only occurs once per alarm activation period, at the beginning of alarm activation. Alarm deactivation returns line 111 to a low level, and when a new alarm signal occurs, the reset pulse 191 is generated again by the one-shot 190, resetting the alarm delay circuitry for processing new alarm delay signals.

These various embodiments incorporate at least the most notable improvements of the present invention, namely: an alarm clock system that allows a gradual but entertaining transition to wakefulness. This advantage is achieved by novel remote control apparatus requiring the user to exercise skill in precisely aiming the same at a target detector on the base unit. Sound effects generated by the gun add to the excitement of operating the device. Additional modifications, such as the inclusion of an announcement congratulating the operator on his or her aim, a whimsical sound effect like an explosion in response to a direct "hit" of the focused beam on the target are also contemplated and believed to be within the scope and spirit of the present invention.

The inventor has given a non-limiting description of several embodiments of the present invention, to which many changes may be made without deviating from the spirit of the invention. After reviewing these various embodiments in light of the forementioned disadvantages of the prior art alarm clock systems employing means for delaying the operation of an activated alarm signal, those skilled in the art will readily ascertain the unique novelty of the alarm clock system of the present invention. While this invention has been described with reference to illustrative embodiments, this description is not intended to be construed in a limiting sense. Various modifications and combinations of the various embodiments as well as other embodiments of this invention will be apparent of a person skilled in the art upon reference to this description.

Furthermore, other changes such as those which are aesthetic, or those which include the substitution of other materials as they become available which perform substantially the same function in substantially the same manner with substantially the same result without deviating from the spirit of this invention may be made. It is therefore contemplated that the appended claims cover any such modifications and/or embodiments that fall within the true scope of the present invention.

The various features of novelty which characterize the alarm clock system of the present invention are pointed out with particularity in the claims appended hereto and forming a part of this disclosure. The more important objects of the present invention have been outlined rather broadly in order that the detailed description thereof which follows may be better understood, and in order that the present contribution to the art may be better appreciated.

What is claimed is:

1. A novelty alarm clock system incorporating a game of skill aspect, comprising:

an alarm clock base unit including a clock assembly operative to display the current time, said clock assembly being further operative to audibly reproduce an audible alarm when the current time corresponds to a preselected alarm time; and a sensing element for detecting a remotely actuated alarm interruption signal, said clock assembly being responsive to detection of the remotely actuated alarm interruption signal to discontinue, for at least an interval of time, audible reproduction of the audible alarm; and a remote unit including a housing physically independent from the alarm clock base unit, said remote unit including a light emitting source configured to produce a narrowly focused beam of light alignable, by movement of the housing, with said sensing element to thereby initiate interruption of the audible alarm.

2. The alarm clock system according to claim 1, wherein the light emitting source includes a light emitting diode.

3. The alarm clock system according to claim 2, wherein the housing is dimensioned and arranged as a toy gun having a handle portion, and elongated barrel portion, and a trigger mechanism for causing actuation of the light emitting source.

4. The alarm clock system according to claim 3, wherein the light emitting source further includes a power supply responsive to actuation of the trigger mechanism to energize the light emitting diode, and a lens assembly for focusing the light emitted by the light emitting diode into a beam and for directing the beam through the barrel of the housing.

5. The alarm clock system according to claim 2, wherein the housing is dimensioned and arranged as an elongated wand having an axial bore and opening at one end thereof.

6. The alarm clock system according to claim 5, wherein the light emitting source further includes a power supply for energize the light emitting diode, and a lens assembly for focusing the light emitted by the light emitting diode into a beam and for directing the beam through the axial bore and the opening.

7. The alarm clock system according to claim 1, wherein the light emitting source includes an incandescent light bulb.

8. The alarm clock system according to claim 7, wherein the housing is dimensioned and arranged as a toy gun having a handle portion, and elongated barrel portion, and a trigger mechanism for causing actuation of the light emitting source.

9. The alarm clock system according to claim 8, wherein the light emitting source further includes a power supply responsive to actuation of the trigger mechanism to energize the incandescent light bulb, and a lens assembly for focusing the light emitted by the incandescent light bulb into a beam and for directing the beam through the barrel of the housing.

10. The alarm clock system according to claim 7, wherein the housing is dimensioned and arranged as an elongated wand having an axial bore and opening at one end thereof.

11. The alarm clock system according to claim 10, wherein the light emitting source further includes a power supply for energize the incandescent light bulb, and a lens assembly for focusing the light emitted by the incandescent light bulb into a beam and for directing the beam through the axial bore and opening.

12. The alarm clock system of claim 1, wherein the remote unit is responsive to actuation of the light emitting source to audibly reproduce a first confirmation signal.

13. The alarm clock system of claim 1, wherein the alarm clock base unit is further responsive to detection of the narrowly focussed beam of light to audibly reproduce a second confirmation signal.

* * * * *